United States Patent [19]

Lingl

[11] 3,930,929

[45] *Jan. 6, 1976

[54] APPARATUS TO CONSTRUCT WALL PANELS HAVING OPENINGS FOR DOORS AND WINDOWS

[75] Inventor: Hans Lingl, Nen-Ulm, Germany

[73] Assignee: Lingl Corporation, Paris, Tenn.

[ * ] Notice: The portion of the term of this patent subsequent to Nov. 19, 1991, has been disclaimed.

[22] Filed: May 24, 1974

[21] Appl. No.: 473,301

Related U.S. Application Data

[63] Continuation-in-part of Ser. No. 409,005, Oct. 23, 1973, Pat. No. 3,849,228.

[30] Foreign Application Priority Data

Nov. 3, 1972 Germany ..... 2253816
July 3, 1973 Germany ..... 2333709

[52] U.S. Cl. ..... 156/558; 52/747; 52/749; 156/560; 156/563; 156/567

[51] Int. Cl.[2] ..... B32B 31/04; E04B 01/00; E04B 02/02

[58] Field of Search ..... 156/556, 563, 578, 559, 156/297, 558, 560, 566, 567; 52/747, 749

[56] References Cited

UNITED STATES PATENTS

| | | | |
|---|---|---|---|
| 2,241,898 | 5/1941 | Bawtenheimer | 52/747 |
| 2,639,608 | 5/1953 | Kirschmann | 52/749 |
| 3,039,233 | 6/1962 | Holmes | 52/749 |
| 3,350,833 | 11/1967 | Larger | 52/749 |
| 3,503,174 | 3/1970 | Nichols | 52/749 |
| 3,585,092 | 6/1971 | Storer | 156/558 X |
| 3,789,101 | 1/1974 | Wright et al. | 52/749 X |
| 3,790,428 | 2/1974 | Lingl | 156/559 |
| 3,849,228 | 11/1974 | Lingl | 156/297 |

*Primary Examiner*—Douglas J. Drummond
*Assistant Examiner*—Thomas Bokan
*Attorney, Agent, or Firm*—Cushman, Darby & Cushman

[57] ABSTRACT

A method and apparatus for the production of prefabricated block wall panels wherein a row of blocks is placed on a conveyor system with the intended vertical joints of the blocks facing upwardly in a horizontal plane. A first mortar applying device applies mortar to these intended vertical joints whereupon the blocks are rotated 90° onto another conveyor system where the now actually vertical joints of the blocks are compressed against each preceeding block. The mortar for the upper horizontal joint is then applied by a second mortar applying device and the thus assembled row of mortared blocks are then stacked onto a descending wall panel comprising a plurality of such rows. Openings for doors and windows may also be provided in the wall panel by aligning blocks into piers and lifting them onto a wall panel. Different sized blocks and cross-pieces may also be fed onto the conveyor system for subsequent stacking onto a wall panel.

5 Claims, 9 Drawing Figures

APPARATUS TO CONSTRUCT WALL PANELS HAVING OPENINGS FOR DOORS AND WINDOWS

BACKGROUND OF THE INVENTION

This application is a Continuation-in-Part of applicant's co-pending application Ser. No. 409,005 filed on Oct. 23, 1973 now U.S. Pat. No. 3,849,228 issued Nov. 19, 1974.

1. Field of the Invention

This invention relates to a method and an apparatus for the manufacture of prefabricated wall panels by vertical stacking of blocks or brick rows which are grouped on a conveyor system from individual blocks. Mortar is then applied by two separate devices to both vertical and horizontal mortar joints and the block row is placed by means of a gripper onto a descending support. Another embodiment of the present invention which is the subject of this Continuation-in-Part application sets forth a method and an apparatus for constructing a wall panel having openings for doors and windows or the like. Also, crosspieces may be automatically inserted into a conveyor system transporting individual blocks and the gripper may be utilized to place the crosspieces in blocks onto the descending support.

2. Description of the Prior Art

The making of wall panels by stacking block rows having a horizontal joint of mortar is known. It is also known to fill the vertical joints after block rows have been stacked. Further, it is known to build wall panels mechanically by individually placing the blocks and filling the vertical joints. The filling of the vertical joints after the blocks or block rows have been placed in a panel has several disadvantages with regard to the production capacity for the manufacturing of such panels, and also with regard to the strength and dimensional precision of same.

To fill several vertical joints, mortar has to be applied by several supply lines periodically interrupted. Because of the partial setting of the mortar during these pauses, uneven supply and filling of the vertical joints results in lower wall strength. Another attendant disadvantage is that when the individual blocks are grouped in walls and transferred to the panel, they are not connected by a vertical mortar joint and thus the alignment to the panel face can change in the process. Furthermore, filling of the vertical joints of the blocks slows down the production process.

A further disadvantage of the process is that the blocks require a special shape for the vertical joints and, therefore, more expensive block material may be required.

Previous methods of prefabricating block wall construction are known. A method is known to apply the mortar on the blocks to form only a horizontal joint as disclosed in the Austrian patent No. 252,089 of Feichtinger, in which blocks are moved through a mortar applicating device, are then tilted 90° after the mortar is applied, and are then closed up in groups where the mortared faces are in a common vertical plane and moved to a horizontal form to be grouped into horizontal panels. However, this method does not provide for a vertical mortar joint in the finished vertical panel and has a further disadvantage in that the mortar may run off during assembly leading to an unevenly filled horizontal joint and resulting in mortar build-up on the conveyor system.

Another method is disclosed in an application of applicant, Ser. No. 186,628, filed Oct. 5, 1971 now U.S. Pat. No. 3,790,428 issued Feb. 5, 1974 and divisional application thereof Ser. No. 413,459 filed Nov. 7, 1973, now U.S. Pat. No. 3,881,981, in which a device and method are disclosed for manufacturing prefabricated wall panel blocks in which rows of blocks are placed upon a conveyor belt so as to leave gaps between the rows. A feeding device then supplies special blocks to at least partially fill these gaps. In the next step mortar is applied to the upper faces of the rows of the blocks, whereupon the rows are then transferred from the conveyor to a descending support device in which panels are created by stacking the rows.

3. Brief Description of the Invention

The present invention contemplates a method and apparatus in which blocks initially are fed onto a system of conveyors so that the intended vertical joint faces are first oriented in a horizontal plane, while the intended horizontal joint faces are first oriented vertically perpendicular to the direction of travel of the blocks. The blocks are then transferred onto the next belt of the conveyor system and controlled to form a closed-up row which moves under a mortar applying device so that mortar is applied onto the intended vertical joint faces of the blocks. After the mortar band is applied to this intended vertical joint, the blocks are individually tilted 90° so that the intended vertical joint mortar band faces are indeed vertical and facing the vertical joint of the preceding block. The blocks are then pushed together by transfer onto a slower moving belt of the transport system so that the vertical joint mortar bands are compressed against the vertical joint faces of the preceding blocks to a required joint thickness, which will determine the length of the row and the width of the panel. Mortar is then applied to the horizontal joints by means of a second mortar applying device, whereupon the now completed row of mortared blocks is transferred to a further belt or the transport system and moved forwardly against a stop, whereupon the entire assembled and mortared block row is picked up by means of a grabbing crane or similar device which places the row of blocks onto a descending support to form a wall panel. The process is repeated until the desired length and height of a wall panel is manufactured.

Advantages achieved by the present invention are that the vertical joint is formed by a simple method in the production system, such that the vertical joints can be made to have different profiles with a wall having higher strength when compared to other known methods. Also of advantage is the possibility of applying the vertical joint with different bands or layers of mortar. For example, several separated bands or layers could be applied to increase the insulation of the wall in the vertical joint area. Applying the vertical joint mortar on a row of blocks at a fixed distance from the conveying support also provides for dimensional precision in the mortar band thickness. After the tilting of the blocks, the horizontal joint is formed with a layer of mortar predetermined by the second mortar applying device such that two dimensional precision (i.e., the thickness of both vertical and horizontal mortar joints) for the manufacturing of the wall panel is assured.

A further advantage is the exact dimensional precision of and uniformity of the vertical as well as the horizontal joints from inside to the outside faces of the block rows, so that a face block panel with a required aesthetic joint appearance can be made.

Additional features of the present invention reside in the insertion of different sized blocks and lintels onto the conveying system so that a wall panel having openings for doors and windows or the like may be constructed. In this embodiment of the invention, there is a final conveyor or place in readiness path wherein blocks may be aligned into piers and then transferred by means of a grabbing crane onto a wall panel. After the piers have been built to a predetermined height, another row of blocks having lintels is set on top of the piers by means of the grabbing crane so that a crosspiece is set over the doors and windows. Additional rows of blocks may then be transported by the grabbing crane onto the preceding blocks and lintels to form a completed wall panel.

The present invention also contemplates the use of a traveling grabbing crane which is constructed in a frame movable along a horizontal direction on a floor surface wherein the gripping means may be moved over the entire height of a wall panel formed. This feature enables wall panels to be built up having doors and windows wherein the wall panels may be placed in rows one behind the other. This is advantageous from a production standpoint in that a wall panel so formed may be allowed to remain where it is placed until the mortar is set. With prior art devices, before another wall panel could be placed on a floor surface by the grabbing crane, the previously formed wall panel had to be moved. Such a system hindered the efficiency of a wall panel instruction production line.

The above enumerated advantages of the instant invention are not apparent in any of the other known methods. The present invention is an improvement of the automatic manufacturing of prefabricated block wall panels and results in high quality as well as high production capacity.

SUMMARY OF THE INVENTION

It is, therefore, an object of the present invention to provide individual blocks with both a vertical and horizontal joint before they are grouped into wall panels, so that the vertical as well as the horizontal joints may be formed precisely and in accordance with the demands of a required wall panel specification.

It is another object of the present invention to make the joint thickness and shape in conformance to a particular construction, for example, with two parallel mortar bands or layers on the vertical joint before the block row is compressed and fed into the wall panel, so that the vertical joint is filled reliably and in even distribution.

It is a further object of the present invention to increase block wall panel stability and strength while providing increased dimensional precision.

Another object of the present invention is to form block layers in the length of a wall panel automatically, and in which mortar is applied to the vertical and horizontal joints which allow the blocks to be stacked to form wall panels in a succeeding step to achieve a required prefabricated wall structure.

A further object of the present invention is to form wall panels having openings for doors and windows or the like, wherein crosspieces are transported above the openings as a part of the production process.

Yet another object of the present invention is to provide for production apparatus for forming wall panels in which different sized blocks may be inserted into the conveying system and also wherein lintels may be inserted into the conveying system, the lintels being used as crosspieces.

A further object of the present invention is to provide for apparatus in which wall panels of substantial length may be produced, the invention also enabling wall panels to be produced in stacks one behind the other so that a wall panel has sufficient time to become stable before being moved.

Still a further object of the present invention is to provide for a wall panel construction apparatus wherein blocks may be set up at a distance from one another on the conveying system so that insulating material can be filled in between the blocks.

Additional objects of the present invention reside in the specific construction of the exemplary apparatus hereinafter particularly described in the specification and shown in the several drawings.

DETAILED DESCRIPTION OF THE INVENTION

Figure 1:
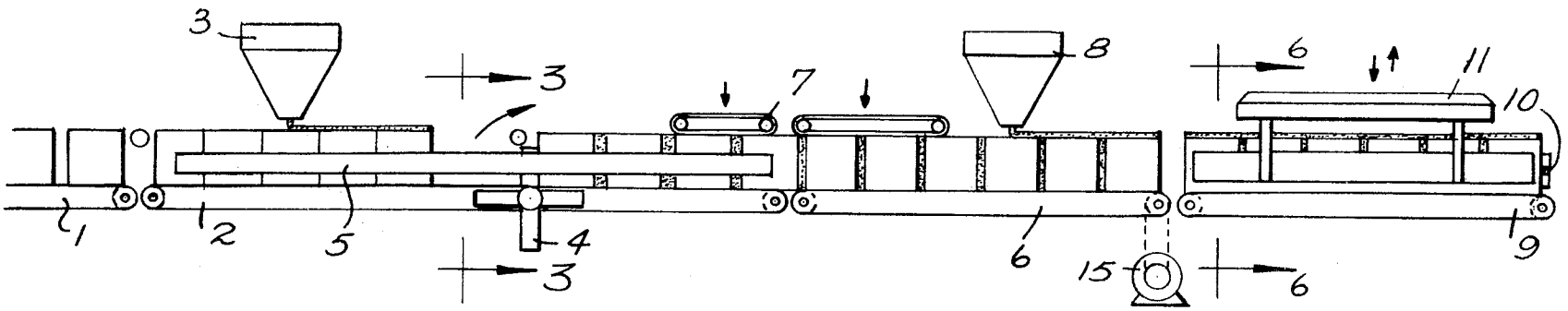
FIG. 1 illustrates a longitudinal side view of the apparatus.

The exemplary embodiment of the present invention comprises a transport system with several conveyor systems. The conveyor systems are shown in the exemplary embodiment as conveyor belts 1, 2, 6 and 9, and these belts are driven in a known conventional manner as by a motor and pulley as indicated at 15.

The process contemplates placing the blocks on conveyor system 1 so that the intended vertical faces of the blocks point vertically upwards initially. In this position, the blocks are closed up into rows by an automatic control. Such an automatic control may be by any conventional well known method. Over conveyor system 2, a mortar applying device 3 is positioned to feed mortar onto the intended vertical face of each block. Following this step, each block with a mortar layer on its vertical face is tilted by means of a tilting device 4 by 90° and is then closed up with the preceding block. The blocks are aligned by means of ledges 5.

The blocks are then transferred to conveyor system 6 which is driven at a slower speed than conveyor system 2 so that the blocks are closed up to a desired vertical joint thickness by compressing the vertical joint mortar. To effectuate this compression and to keep the blocks from slipping on conveying systems 2 and 6, the blocks are pressed down from the top by means of conveyor systems 7.

Figure 2:
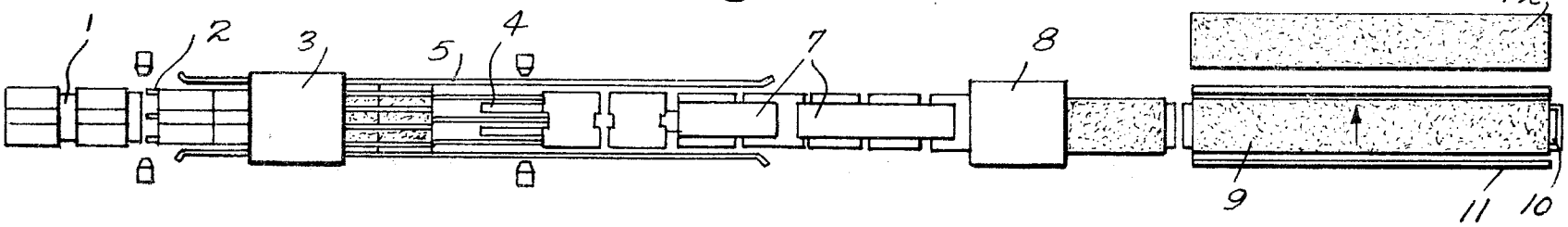
FIG. 2 illustrates a top view of FIG. 1.
Figure 3:
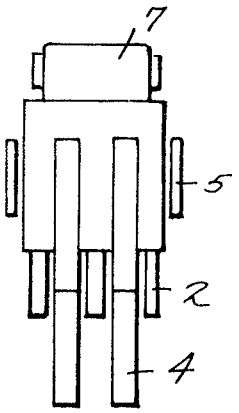
FIG. 3 diagrammatically illustrates the section shown taken along lines 3—3 in FIG. 1.

Following this step, the horizontal face is applied with mortar by means of a second applying device 8 and each block is then transferred onto conveyor system 9. Conveyor system 9 transports a predetermined number of blocks up against a stop 10 whereupon a gripping means such as a gripping crane 11, picks up the predetermined row of blocks in a known way and places them onto the descending support 12. The descending support 12 as can be readily seen from viewing FIG. 2, is the preceding row of blocks having mortar applied to the horizontal faces.

Figure 5:
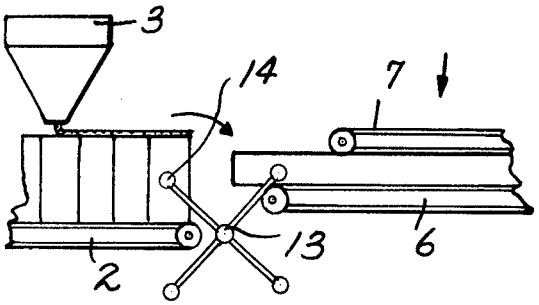
FIG. 5 illustrates the tilting device used for rotation of rectangular shaped bricks.
Figure 6:
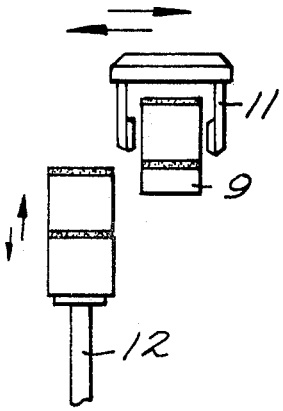
FIG. 6 shows a section taken along lines 6—6 of FIG. 1.

By viewing FIG. 5, it can be seen that the tilting device 13 is utilized for vertical joint formation of rectangular block types. To apply mortar to shapes with rectangular form, a tilting device is used which grips the blocks on their side faces with rotating gripping brackets or jaws 14, and transfers the blocks onto an elevated conveyor system 6a while rotating the blocks 90°. Such a method has a relatively high speed production capacity to provide for a continuous stream of blocks.

Figure 4:
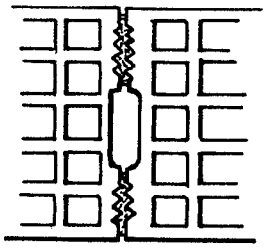
FIG. 4 shows an example of the vertical joint in which serrated edges are employed on the blocks.

In FIG. 4, the vertical face of the blocks is shown with a serrated shaped face. Such a serrated shaped face would increase strength of the vertical joints by increasing the frictional resistance between the vertical joints.

Figure 7:
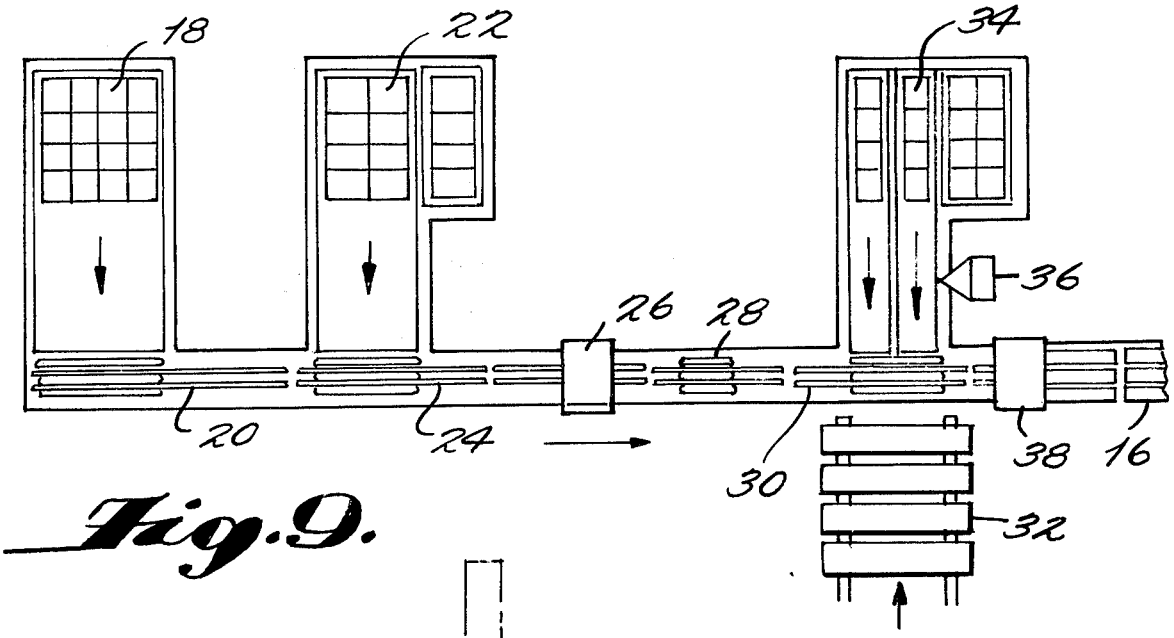
FIG. 7 is a top view of the apparatus of another embodiment of the present invention.
Figure 9:
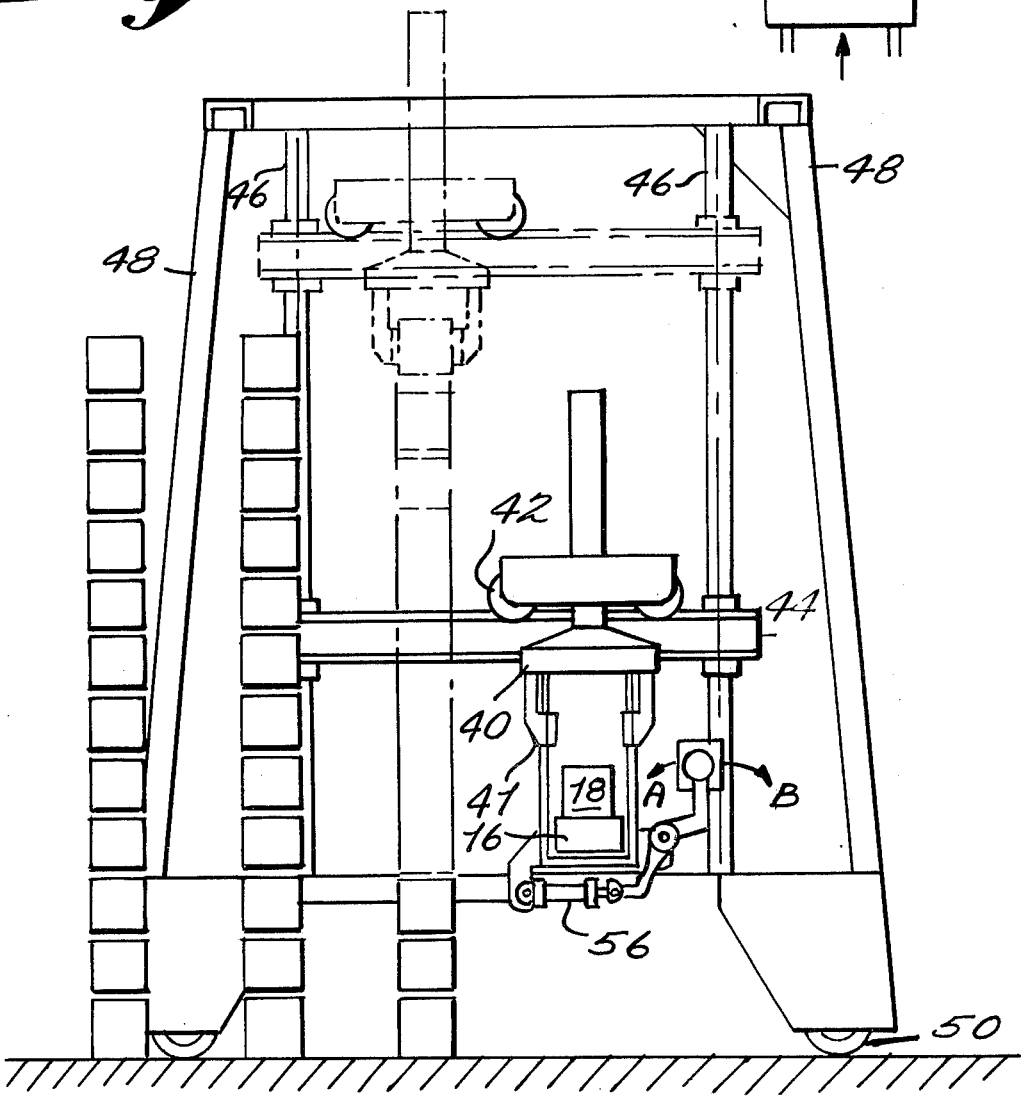
FIG. 9 is a view taken along lines 9—9 of FIG. 8.
Figure 8:
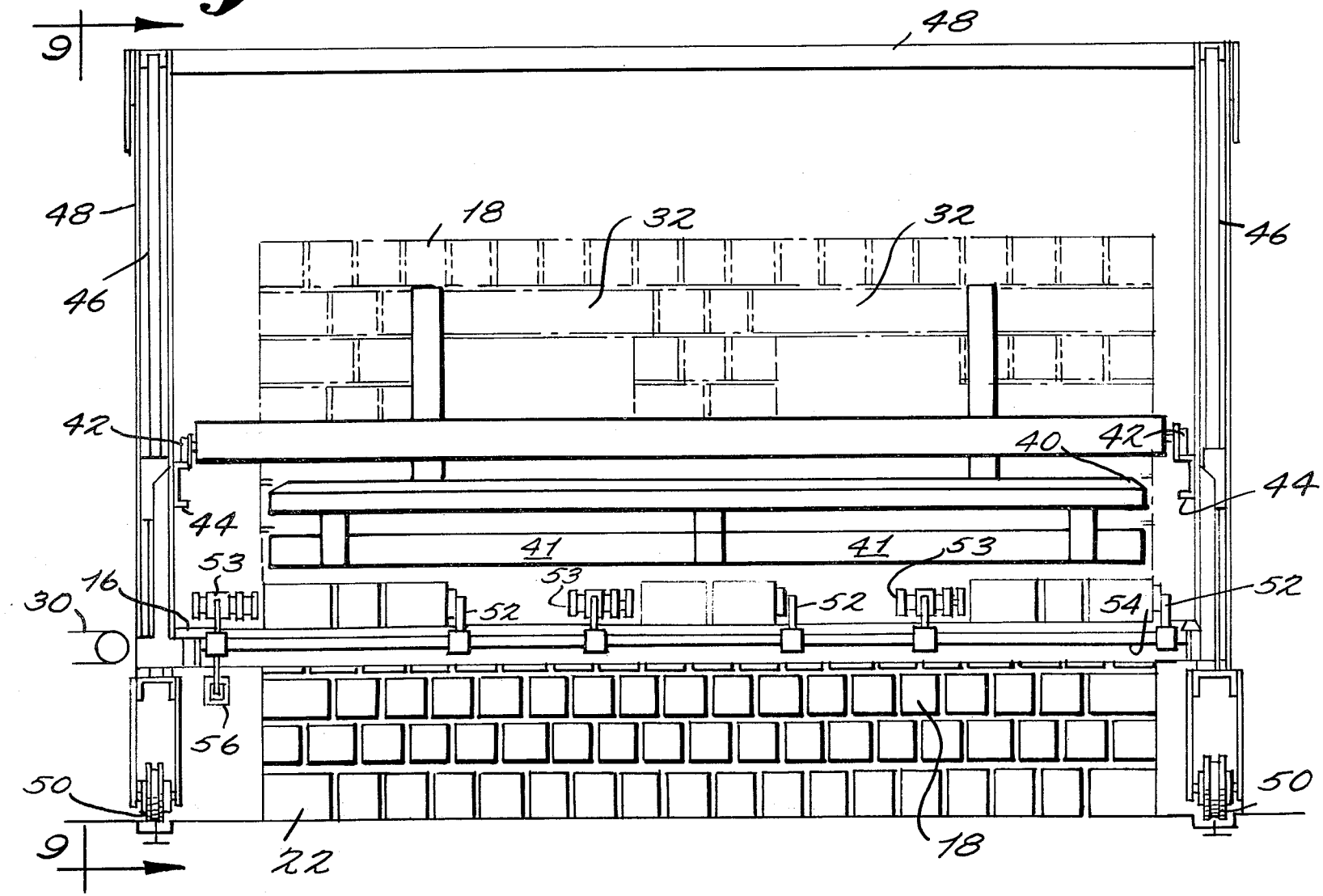
FIG. 8 is a side view of the transfer grab illustrating the construction of a wall panel having openings for doors and windows.

Now, the operation and advantages of the embodiment of the present invention as illustrated in FIGS. 7–9 will be described. In FIG. 7 there is shown a conveying system utilizing a plurality of conveyors for transporting the blocks to a final conveyor or place in readiness path 16. Blocks of a first size 18 may be fed from a source onto a first conveyor 20 for transport to mortar applying devices. Also, blocks 22 sized differently from blocks 18 may be fed onto conveyor 24 to provide for a wall panel having different sized blocks. A mortar applying device 26 similar to mortar applying device 3 as hereinabove described, applies mortar to the intended vertical faces of blocks 18 or a combination of blocks 18 and 22.

A tilting device 28 then tilts the blocks in the same manner as did tilting device 4. The blocks are then transferred to conveyor 30 which preferably is run at a speed lower than the previous conveyor so that the blocks transported thereupon will be pressed tightly together to aid in the setting of the mortar. Arranged adjacent to conveyor 30 are lintels 32 and blocks of a third size 34. The lintels are used as crosspieces over doors and windows in a wall panel. The special blocks 34 may be coated with mortar on a vertical face by mortar applying device 36 before being placed on conveyor 30. Another mortar applying device 38 is utilized for application of mortar to the horizontal faces of blocks passing thereunder and also for application of mortar to a top surface of the lintels.

The construction of a typical wall panel having openings for doors and windows will now be described. Blocks 18 and 22 will be transported to the final conveyor 16 being covered with mortar and pressed together in the manner as previously set forth. A gripping means, commonly referred to as a grabbing crane 40 grabs a predetermined number of blocks 18 and 22 from conveyor 16 and transports them onto a floor surface or the like. The process is repeated until a solid wall of a certain predetermined height has been constructed. As may be seen from a consideration of FIGS. 8 and 9, grabbing crane 40 has wheels 42 which enable crane 40 to travel horizontally along horizontal guides or rails 44. Vertical guides or posts 46 are slidably engaged with rails 44 so that crane 40 may be displaced upwardly as shown in FIG. 9. A frame 48 is movable along a floor surface by virtue of wheel means 50 secured to frame 48 in a known manner.

After a predetermined number of rows of blocks 18 and 22 have been stacked one on top of another, openings for windows or the like may then be constructed. Blocks 18 and 22 are grouped along the conveyors preceding conveyor 16 in numbers corresponding to the width of desired piers. As shown in FIG. 8, piers of three, two and three are arranged on conveyor 16. Aligning means or stops 52 are rotatably secured to pivot arm 54 and serve as a stopping point for blocks in a particular pier. Planes of sighting 53 are used as a final alignment means and are also rotatably secured to pivot shaft 54. When blocks corresponding to a certain number of piers are transported to conveyor 16 the sighting levels 53 and the stops 52 are rotated out of the way as shown in FIG. 9. After the blocks corresponding to the piers are in their positions generally on conveyor 16, stops 52 and planes of sighting 53 are then pivoted downwardly in the direction of arrow A so that the planes of sighting 53 may be displaced along pivot shaft 54 to line up the blocks against stops 52. Pivotal movement of stops 52 and planes of sighting 53 may be realized by conventional hydraulic actuators 56 or other similar means. The movement of planes of sighting 53 to push the blocks against stops 52 may also be remotely controlled.

After the blocks have been properly aligned, pivot shaft 54 is actuated to move planes of sighting 53 and stops 52 in the direction of arrow B so that crane 40 may be operated to grip onto the blocks with arms 41 to lift them onto the previous row. The process is repeated until piers of a desired height are constructed. The placing of lintels 32, which serve as crosspieces, is carried out in a manner similar to that described for the transport in placing of blocks. As blocks 18 and 22 are covered with mortar from application device 26 and are then subsequently tilted by device 28, lintels 32 are placed onto conveyor 30 adjacent to special blocks 34 (which are coated with mortar from application device 36). It should be noted that special blocks 34 may not be required, but are illustrated to adequately disclose the flexibility of the present system. After blocks and lintels are joined together in a continuous row on path 16, crane 40 then lifts the row into its proper position as shown in FIG. 8. Thereafter, subsequent rows of any desired number of blocks may be placed thereupon in order to complete a desired wall panel.

From a consideration of FIG. 9, it can be seen that several different wall panels may be constructed along a line, one behind the other, without first removing one of the wall panels. Such a construction of a plurality of wall panels is made possible by the fact that frame 48 is movable. In previous production devices, a constructed wall panel would have to be first moved before the grabbing crane could begin stacking a new wall panel. Such a feature was relatively inefficient in that a previously constructed wall panel had to remain at rest at least long enough for the mortar to set. With the present invention, it may be readily appreciated that the flexibility of a movable crane 40 provides for construction of wall panels wherein the previous wall panels do not have to be moved.

A further process includes the insertion of insulating material between blocks while the blocks are being conveyed. This would require that blocks be separated a certain distance apart and the insulating material being added or filled in between the blocks. Insulating material could be placed in the space adjacent blocks as shown in FIG. 4, or could be placed in the openings already present in many building construction blocks.

Because frame 48 enables grabbing crane 40 to move in a plurality of positions, it may also be seen that two wall panels could be placed directly together in order to form a thicker wall, or could be separated if so desired.

The above-described device could, of course, be constructed using different numbers of conveying systems, etc. It must be remembered that the foregoing specific embodiment has been described for the purpose of illustrating the principles of the present invention and the same is subject to modification as will be apparent. Therefore, the invention includes all modifications within the spirit and scope of the appended claims.

What is claimed is:

1. An apparatus for the production of wall panels having openings for doors and windows by perpendicular superposition of rows of blocks wherein said blocks have mortar disposed between both their horizontal and vertical faces in which said apparatus comprises:

a. a conveying means adapted to support and transport a row of blocks;

b. means for aligning said blocks with their intended vertical faces horizontally oriented;

c. first applying means for applying mortar of a predetermined thickness onto the intended vertical faces of said blocks;

d. means for turning said blocks by 90° after passage from said first applying means whereby the intended vertical faces are oriented vertically and the intended horizontal faces are oriented horizontally;

e. means for bringing the intended vertical faces together to form vertical joints;

f. second applying means for applying mortar of a predetermined thickness onto said intended horizontal faces of said turned blocks;

g. second aligning means disposed adjacent to an end section of said conveying means for aligning portions of a row of blocks into groups which form piers when rows of blocks comprising said groups are stacked on top of another; and h. means for transporting a predetermined number of said blocks onto a horizontal support so that a row of a wall panel of such blocks is formed.

2. An apparatus as described in claim 1 wherein a third applying means is disposed adjacent to said conveying means for applying mortar of a predetermined thickness to additional blocks which are inserted onto the conveying means subsequent to said turning means.

3. An apparatus as described in claim 1 wherein said second aligning means comprises a plurality of sighting levels each operatively engaged with a stop, said sighting levels and stops being secured to a pivot arm arranged to pivot said sighting levels and stops to engage groups of blocks and align them according to predetermined orientations, said pivot arm also being operative to pivot said sighting levels and stops to a position so that said means for transporting can lift the blocks off of the end section of said conveying means.

4. An apparatus as described in claim 3 wherein said means for transporting is disposed on a frame which is movable over a floor surface or the like, said frame enabling said means for transporting to lift blocks off of said conveying means and stack said blocks into wall panels, said wall panels being produced in a line one after another.

5. An apparatus as described in claim 3 wherein means for introducing lintels onto said conveying means is disposed adjacent to said conveying means at a position following said turning means.

* * * * *